US007020986B1

(12) United States Patent
Nakai et al.

(10) Patent No.: US 7,020,986 B1
(45) Date of Patent: Apr. 4, 2006

(54) DRUM TYPE WASHING AND DRYING MACHINE

(75) Inventors: Koji Nakai, Hyogo (JP); Takahiro Inoue, Nara (JP); Yoshitomo Kato, Osaka (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 11/090,390

(22) Filed: Mar. 28, 2005

(30) Foreign Application Priority Data

Nov. 11, 2004 (JP) ..... 2004-327423

(51) Int. Cl.
*F26B 11/02* (2006.01)

(52) U.S. Cl. ..... 34/596; 68/139

(58) Field of Classification Search ..... 34/82, 34/595, 596; 68/139, 19.2
See application file for complete search history.

(56) References Cited

U.S. PATENT DOCUMENTS 6,434,857 B1 * 8/2002 Anderson et al. ..... 34/595
6,954,995 B1 * 10/2005 Kitamura et al. ..... 34/597
2004/0079121 A1 * 4/2004 Yabuuchi et al. ..... 68/19.2

FOREIGN PATENT DOCUMENTS

JP 2000-093697 4/2000
JP 2001-300192 10/2001
JP 2004-97388 * 4/2004

* cited by examiner

*Primary Examiner*—S. Gravini
(74) *Attorney, Agent, or Firm*—Bacon & Thomas, PLLC

(57) ABSTRACT

A drum type washing and drying machine includes a cylindrical rotary drum provided with multiple drum perforations on the cylindrical surface thereof and having a rotating shaft in a horizontal or a slanted direction, a water tub, supported in a main body of the machine, for accommodating the rotary drum therein; an air circulation channel for re-circulating air exhausted from the rotary drum back into the rotary drum via a dehumidification unit and a heating unit; and a lint trap device, installed in the air circulation channel, for filtering lint generated from laundry. The lint trap device at least includes a first and a second filter member capable of being detachably attached to each other, and the assembly of the first and the second filter member is freely attachably and detachably installed on a front upper portion of the main body in an approximately horizontal direction.

12 Claims, 6 Drawing Sheets

DRUM TYPE WASHING AND DRYING MACHINE

FIELD OF THE INVENTION

The present invention relates to a drum type washing and drying machine for performing washing, rinsing, water-extracting and drying processes in a rotary drum having a substantially horizontal or slanted rotational axis.

BACKGROUND OF THE INVENTION

A conventional drum type washing and drying machine includes a cylindrical rotary drum disposed in a water tub, wherein its rotational axis is horizontal or slanted with respect to the horizontal direction. The cylindrical rotary drum having a bottom surface is provided on its cylindrical surface with multiple drum perforations for allowing water and air to pass therethrough and is driven to rotate. Further, formed at a front side of the water tub is a laundry loading/unloading opening, which is opened and closed with a door. After loading laundry in the rotary drum through the laundry loading/unloading opening, washing, rinsing and water-extracting processes are performed by controlling water supply into the water tub and water drain therefrom and also by controlling the rotation of the rotary drum.

Moreover, by forming an air circulation channel for exhausting air from the water tub, running thus exhausted air through a dehumidification unit and a heating unit and re-circulating thus dehumidified and heated air back into the water tub, a drying process for drying laundry accommodated in the rotary drum can be performed. In such a way, the drum type washing and drying machine is capable of executing the drying process in addition to the washing, the rinsing and the water-extracting process. Detergent can be added into a detergent dispenser prior to starting the operation of the drum type washing and drying machine and a control panel can be manipulated as needed to set up a desired operation process of the washing and drying machine, start or temporarily pause the operation, and find out the operation status thereof.

In the drum type washing and drying machine having the above-described configuration, a lint trap filter for filtering, e.g., lint produced from laundry during the drying process is installed in the air circulation channel in order to prevent the lint from being accumulated in the air circulation channel or in a fan. The lint trap filter is configured to be attached to or detached from the drum type washing and drying machine by opening a lid plate provided on a top surface of a main body of the drum type washing and drying machine so that the lint collected in the lint trap filter can be removed at any time. By removing the lint, deterioration of air flow efficiency can be prevented (see, for example, Japanese Patent Laid-open Application No. 2000-093697).

Moreover, the lint trap filter for filtering, e.g., lint produced during the drying process includes a first filter disposed at a warm air input side and having a bag-shaped portion whose warm air input side is opened; and a plane-shaped second filter disposed at a warm air output side. For example, lint of a relatively large size produced from laundry is filtered by the bag-shaped portion of the first filter while dust of a minute size is collected in the second filter (see, for example, Japanese Patent Laid-open Application No. 2001-300192).

For such a conventional structure of the lint trap filter, however, it frequently happens that a user operates the drum type washing and drying machine without mounting one of the two filters of the dual system to a main body of the drum type washing and drying machine. In such a case, lint would be accumulated in the air circulation channel or in a fan, resulting in deterioration in air flow efficiency and drying efficiency.

Furthermore, the conventional lint trap filter disclosed in Japanese Patent Laid-open Application No. 2001-300192 is disadvantageous in that the two filters are installed separately and the attachment thereof is somewhat troublesome.

SUMMARY OF THE INVENTION

It is, therefore, an object of the present invention to provide a drum type washing and drying machine of an improved appearance capable of allowing a user to readily recognize the presence of a lint trap device to thereby prompt the user to remove lint from the lint trap device and thus prevent deterioration in air flow efficiency and drying efficiency due to the accumulation of the lint in the lint trap device, and also capable of preventing the user from forgetting to attach the lint trap device and allowing the removal of the lint from the lint trap device to be performed easily, to thereby improve user convenience.

In accordance with a preferred embodiment of the present invention, there is provided a drum type washing and drying machine including: a cylindrical rotary drum provided with multiple drum perforations on the cylindrical surface thereof and having a rotating shaft in a horizontal or a slanted direction, a water tub, supported in a main body of the drum type washing and drying machine, for accommodating the rotary drum therein; an air circulation channel for re-circulating air exhausted from the rotary drum back into the rotary drum via a dehumidification unit and a heating unit; and a lint trap device, installed in the air circulation channel, for filtering lint generated from laundry, wherein the lint trap device at least includes a first filter member and a second filter member capable of being detachably attached to each other, and an assembly of the first filter member and the second filter member is installed at a front upper portion of the main body, the assembly being attachably and detachably installed in an approximately horizontal direction.

BRIEF DESCRIPTION OF THE DRAWINGS

The above and other objects and features of the present invention will become apparent from the following description of preferred embodiments given in conjunction with the accompanying drawings, in which.

DETAILED DESCRIPTION OF THE PREFERRED EMBODIMENTS

Hereinafter, preferred embodiments of the present invention will be described in detail with reference to the accompanying drawings. Here, it is to be noted that the present invention is not limited thereto.

A drum type washing and drying machine in accordance with a preferred embodiment of the present invention will be described in connection with FIGS. 1 to 6B.

Figure 1:
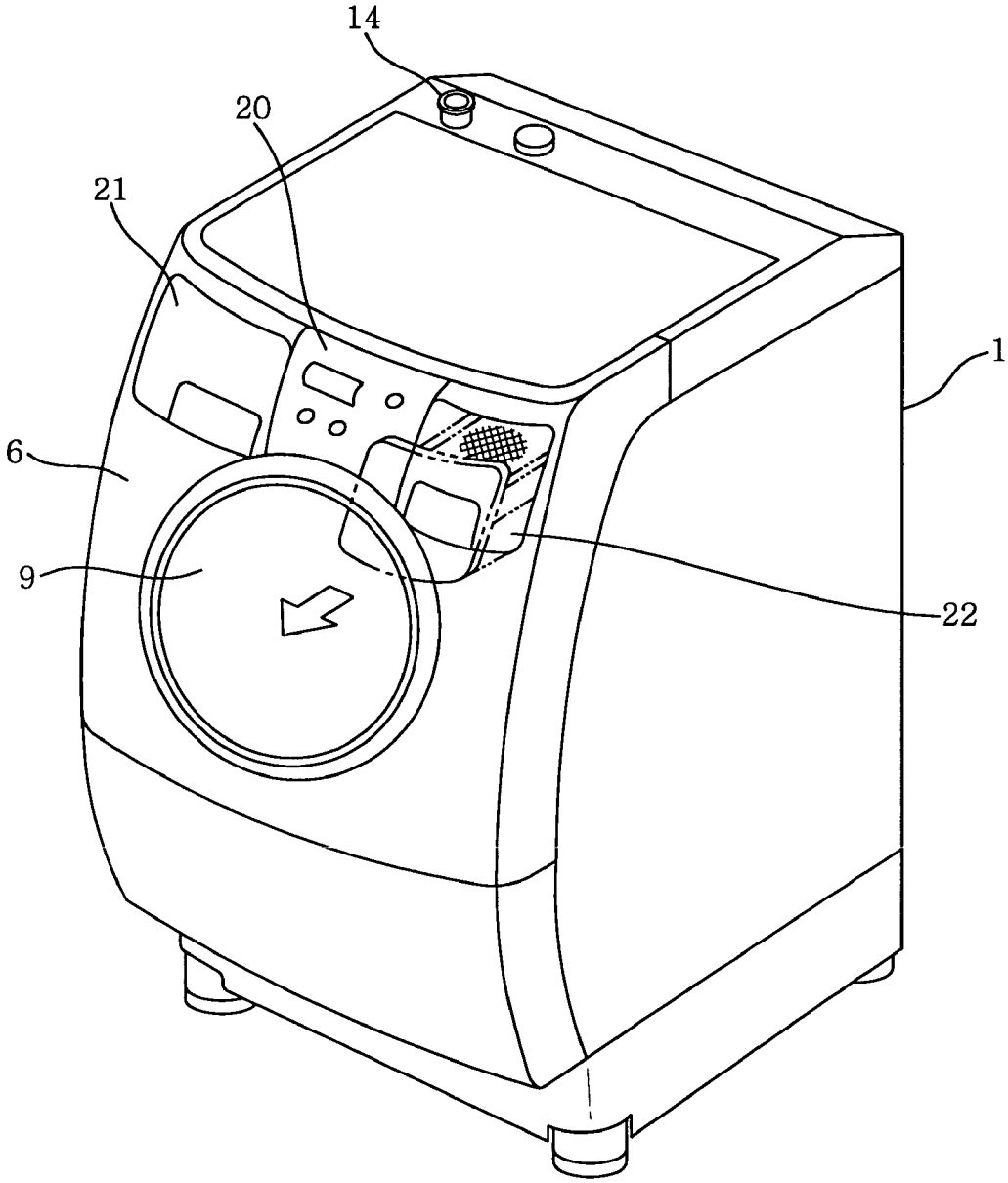
FIG. 1 is a perspective view of a drum type washing and drying machine in accordance with a preferred embodiment of the present invention.
Figure 2:
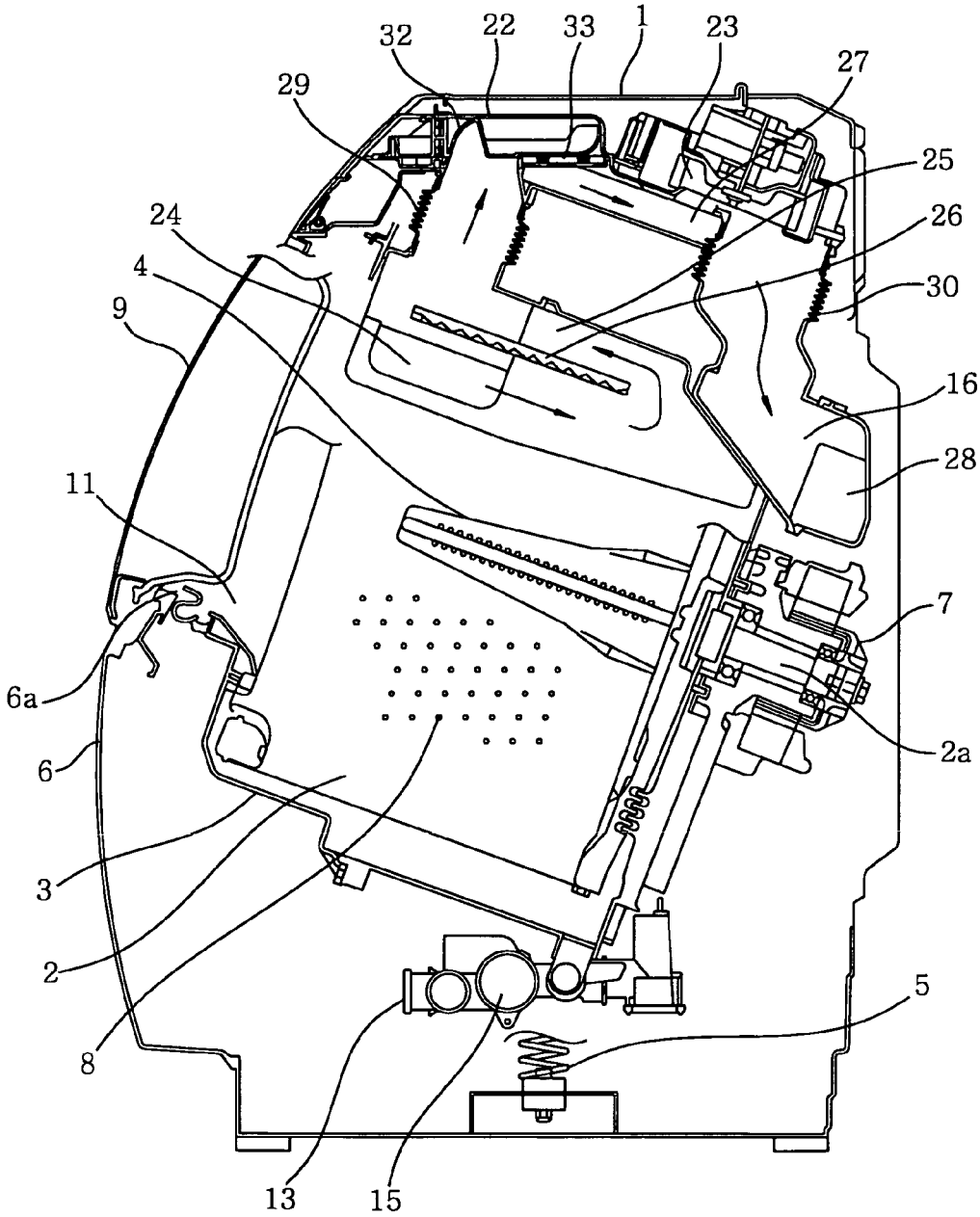
FIG. 2 sets forth a schematic cross sectional view of the drum type washing and drying machine in accordance with the preferred embodiment of the present invention.

Referring to FIGS. 1 and 2, main body 1 of the drum type washing and drying machine has therein water tub 3 suspended on damper structure 5, and cylindrical rotary drum 2 having a bottom surface is rotably installed in water tub 3, wherein the axial direction of its rotating shaft 2*a* is downwardly declined toward rear. Further, provided at a front side of water tub 3 is laundry loading/unloading opening 11 that is configured to communicate with an opening of rotary drum 2. After opening door 9 for opening or closing opening 6*a* provided at an inclined surface of front frame 6 forming a front surface portion of main body 1, laundry can be loaded into or unloaded from rotary drum 2 through laundry loading/unloading opening 11. By installing door 9 at the inclined surface, a user can load and unload the laundry without bending down, ameliorating the inconvenience of a conventional drum type washing and drying machine employing a structure of loading and unloading laundry into and from rotary drum 2 through an opening provided to be opened horizontally.

Rotary drum 2 is provided with multiple drum perforations 8 communicating with water tub 3 on its cylindrical surface, and agitation blades 4 are installed at a plurality of locations on an inner cylindrical surface of rotary drum 2. Rotary drum 2 is driven to rotate in forward and backward direction by motor 7 installed at the rear side of water tub 3. Further, water supply conduit (not shown) and water drain conduit 13 are connected to water tub 3, and water supply into water tub 3 and water drain therefrom are performed under the control of water supply valve 14 and water drain valve 15.

Control panel 20 is provided at an upper central portion of front frame 6. Thus, user can set a desired operation and starts or pauses the operation of the drum type washing and drying machine by using control panel 20, while being informed of the operating state thereof.

Moreover, the drum type washing and drying machine in accordance with the preferred embodiment has a drying function for drying the laundry accommodated in rotary drum 2. For the purpose, there is formed air circulation channel 16 for exhausting air in water tub 3, dehumidifying thus exhausted air, heating thus dehumidified air and recirculating thus heated dry air back into water tub 3.

When the operation of the drum type washing and drying machine is initiated after loading laundry into rotary drum 2 through opening door 9, water supply valve 14 is opened and a predetermined amount of water is fed into water tub 3 via the water supply conduit (not shown). At this time, the detergent supplied into detergent dispenser 21 is dissolved in the water introduced into detergent dispenser 21 to be added into water tub 3. Then, rotary drum 2 is driven to rotate by motor 7 to initiate a washing process. As a result of the rotation of rotary drum 2 during the washing process, the laundry accommodated in rotary drum 2 is repeatedly lifted up in the rotational direction of rotary drum 2 by agitation blades 4 and then dropped. As the laundry is agitated in rotary drum 2, the laundry is subject to pounding motions to be washed.

After the lapse of a predetermined washing time, water drain valve 15 is opened, and soiled water is discharged via water drain conduit 13. Then, by performing a water-extracting process wherein rotary drum 2 is rotated at a high rotational speed, water contained in the laundry is extracted therefrom. Thereafter, fresh water is fed into water tub 3 via the water supply conduit (not shown), and a rinsing process is performed. During the rinsing process, the agitation of the laundry, wherein the laundry articles are lifted up by agitation blades 4 and then dropped, is repeated by the rotation of rotary drum 2, thereby the rinsing process of the laundry being performed. After the completion of the rinsing process, a water-extracting process for rotating rotary drum 2 at a high rotational speed is performed.

Upon the completion of the water-extracting process, a drying process is executed. During the drying process, rotary drum 2 is rotated preset times, and the agitation of laundry for lifting up the laundry articles by agitation blades 4 in the rotational direction of rotary drum 2 to be dropped thereafter is repeated. In addition, air in the interior of rotary drum 2 is dehumidified and heated in the following sequence to be used in drying the laundry.

That is, by rotating fan 23 disposed in air circulation channel 16, airflow is generated within air circulation channel 16 as shown by arrows in FIG. 2. Specifically, damp air in rotary drum 2 accommodating wet laundry therein is blown into water tub 3 through drum perforations 8 and is directed into dehumidification pipe 25 via air outlet 24 of water tub 3. Disposed in dehumidification pipe 25 is heat exchanger plate 26 which is cooled down by, e.g., spray of water supplied from water supply valve 14. Thus, the damp air exhausted from water tub 3 is cooled while it passes through heat exchanger plate 26 and dehumidified as moisture contained therein is condensed.

Thus dehumidified air is then blown to lint trap device 22 via first bellows hose 29, so that lint generated from the laundry during the drying process is removed therefrom. Then, the lint-free air is sent to fan 23 via air flow passage 27 and then is heated by a drying heater (not shown) after traveling through second bellows hose 30. Then, thus heated dry air is blown into water tub 3 through warm air inlet 28 to be re-circulated into rotary drum 2. As such air circulation is repeated for a preset period of time, moisture contained in the laundry is gradually evaporated, and the drying process of the laundry is completed.

As can be seen from FIG. 1, lint trap device 22 is installed at an upper corner portion of front frame 6 of main body 1. Lint trap device 22 will be explained in detail hereinafter with reference to FIGS. 3 and 4.

Figure 3:
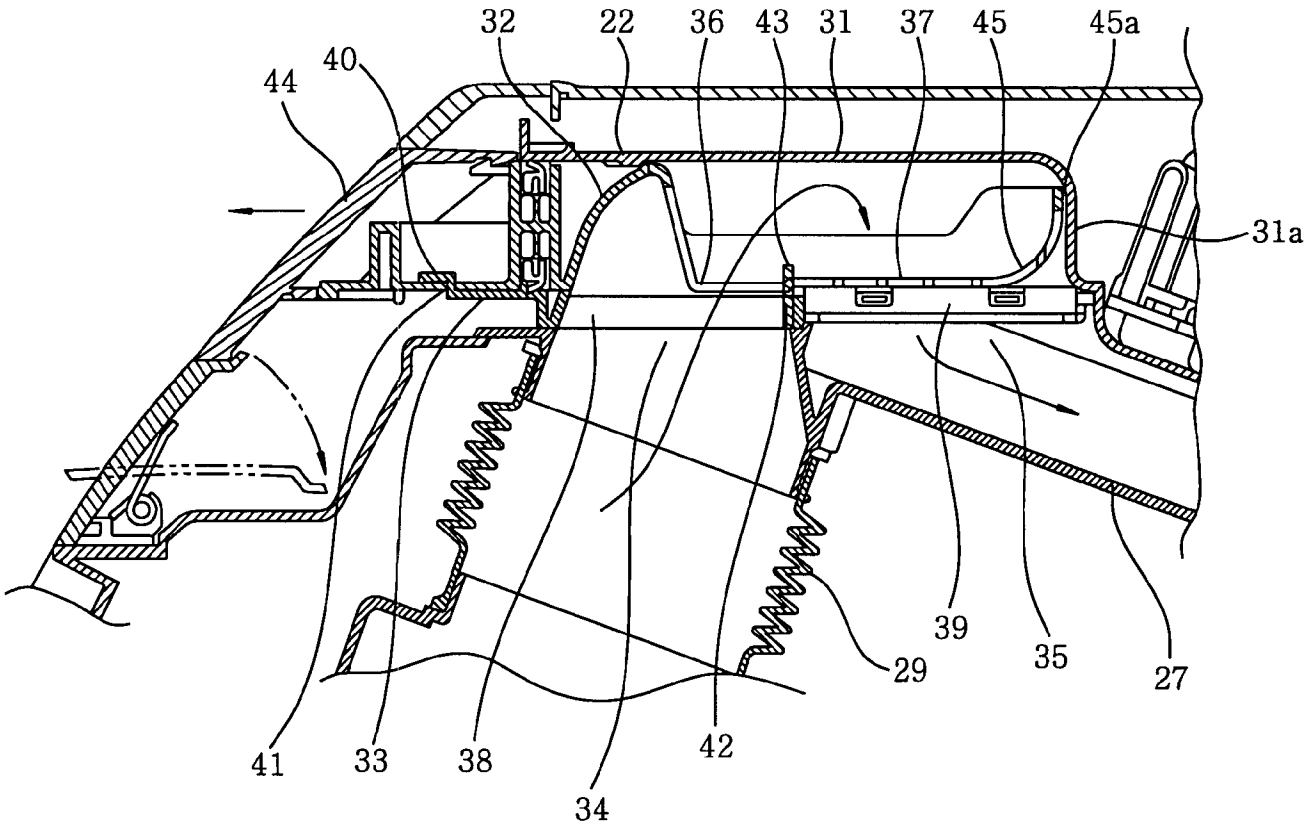
FIG. 3 presents a cross sectional view showing main components installed adjacent to a lint trap device of the drum type washing and drying machine in accordance with the preferred embodiment of the present invention.
Figure 4:
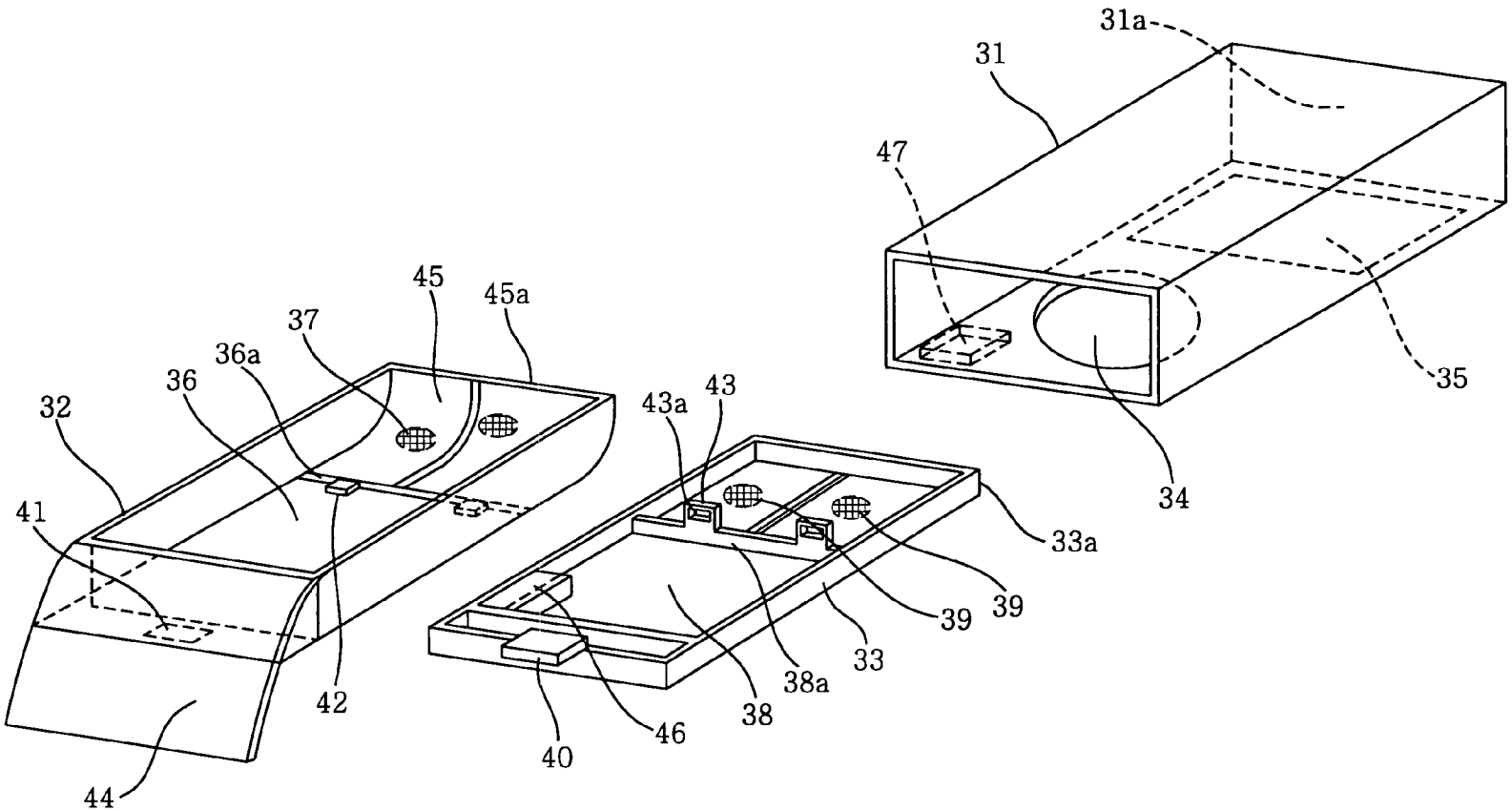
FIG. 4 provides a perspective view showing main components when the lint trap device in accordance with the preferred embodiment of the present invention is detached.
Figure 5:
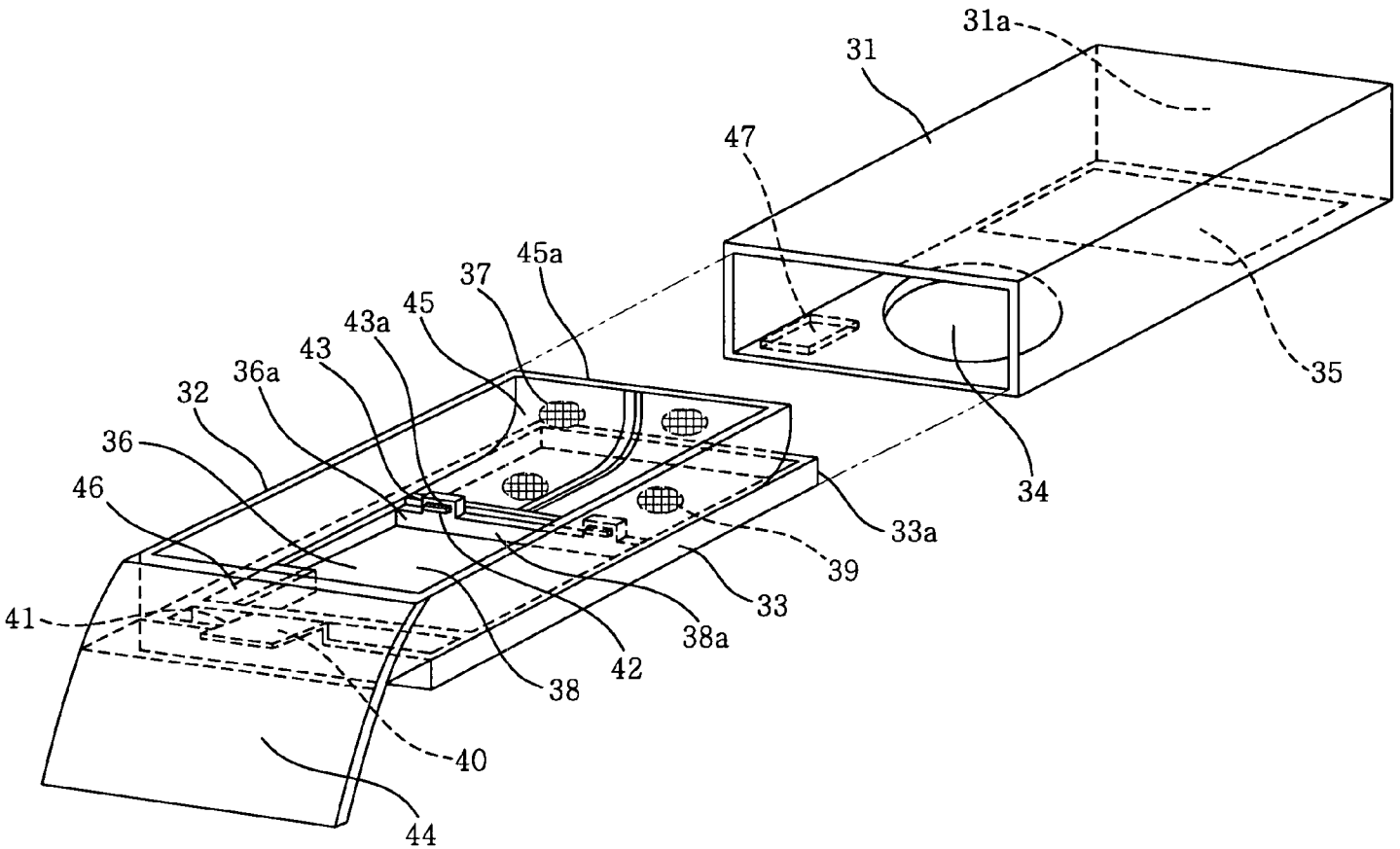
FIG. 5 illustrates a perspective view showing main components when the lint trap device in accordance with the preferred embodiment of the present invention is attached.

As can be seen from FIGS. 3 and 4, lint trap device 22 includes filter accommodating member 31, first filter member 32 and second filter member 33. Provided at the bottom surface of filter accommodating member 31 are air inlet 34 through which air from first bellows hose 29 is introduced; and air outlet 35 through which the air is discharged into air flow passage 27.

Further, first opening 36 for allowing air introduced from below to pass therethrough is provided at a portion of first filter member 32 to correspondingly face air inlet 34, and first filter 37 having an approximately planar shape is disposed at a portion of first filter member 32 to correspondingly face air outlet 35. Further, second opening 38 for allowing the air introduced from below to pass therethrough is provided at a portion of second filter member 33 to correspondingly face air inlet 34 and second filter 39 having an approximately planar shape is disposed at a portion of second filter member 33 to correspondingly face air outlet 35. Second filter member 33 is attachably and detachably secured to the bottom surface side of first filter member 32. The configuration of second filter member 33 will be described in detail hereinbelow.

Formed at a front portion of second filter member 33 is hook rib 40 which protrudes forward, and hook engagement opening 41 for receiving hook rib 40 to be fitted to be engaged therewith is provided at first filter member 32. Further, protrusion rib 42 protruded inside toward first opening 36 is formed at rear end portion 36*a* of first opening 36 of first filter member 32, and locking portion 43 having opening 43*a* for locking protrusion rib 42 is formed at rear end portion 38*a* of second opening 38 of second filter member 33.

Figure 6A:
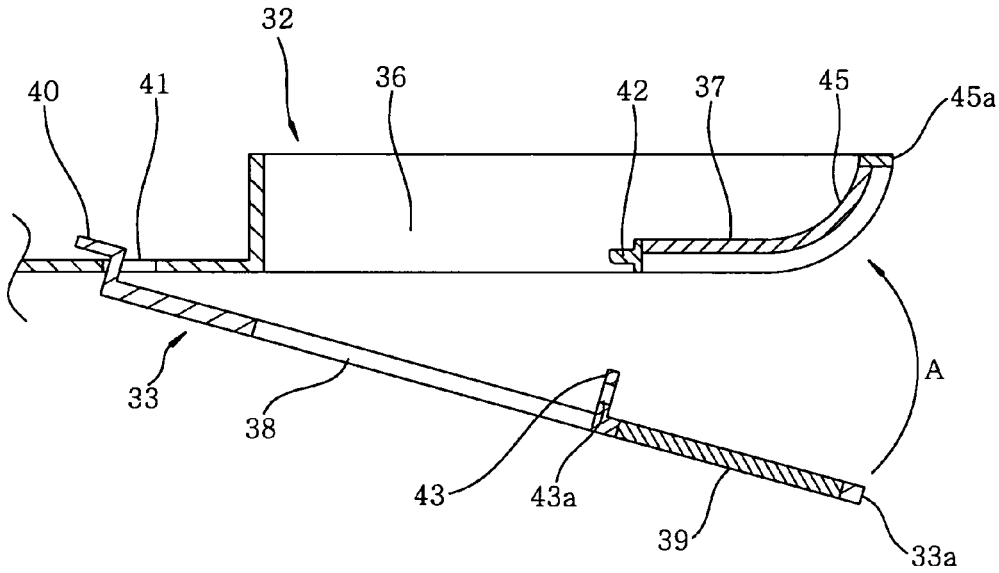
FIG. 6A offers a cross sectional view describing the lint trap device of the drum type washing and drying machine in accordance with the preferred embodiment of the present invention while it is being detached and FIG. 6B depicts a cross sectional view describing the lint trap device when it has been attached.
Figure 6B:
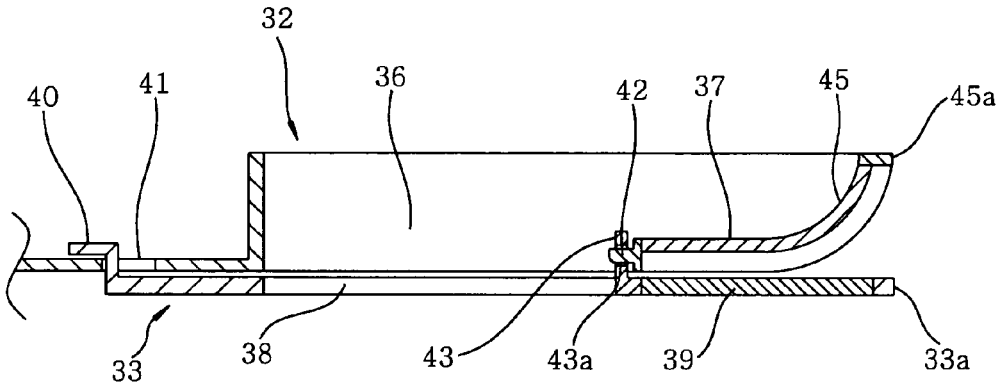

In case of attaching second filter member 33 to first filter member 32 in the above configuration, hook rib 40, which is formed at a front portion of second filter member 33 such that it protrudes upward and forward, is fitted into hook engagement opening 41 provided at the front portion of first filter member 32 as shown in FIG. 6A. Then, by rendering the backside of hook rib 40 to be supported by a surface at a location in front of hook engagement opening 41, second filter member 33 is rotated in the direction of arrow A such that first filter member 32 overlaps with second filter member 33. At this time, though the upper end of locking portion 43 of second filter member 33 makes a contact with the bottom surface of protrusion rib 42 of first filter member 32, locking portion 43 is bent inside toward second opening 38, while allowing protrusion rib 42 to be inserted through opening 43*a* of locking portion 43 and engaged in that position. As a consequence, second filter member 33 can be engaged with first filter member 32 such that first filter member 32 is placed on top of second filter member 33, as shown in FIG. 6B.

Further, in case of detaching second filter member 33 from first filter member 32, locking portion 43 is bent inside toward second opening 38, whereby protrusion rib 42 can be released from opening 43*a* of locking portion 43. Thus, second filter member 33 can be detached from first filter member 32 by using the method in reverse order to that for the case of the attachment thereof.

The assembly of first filter member 32 and second filter member 33 obtained as described above is moved horizontally (in back and forth direction) into filter accommodating member 31 installed at the upper corner portion of front frame 6 of main body 1, whereby it can be freely detachably attached to filter accommodating member 31. Further, provided at the front portion of first filter member 32 is handle 44 to be used for attaching and detaching thereof to and from filter accommodating member 31, wherein handle 44 is configured such that it is located on the same plane as front frame 6.

Further, the size of meshes of second filter 39 is set to be equal to or finer than that of the meshes of first filter 37, so that lint or dust that has escaped from first filter 37 can be filtered out by second filter 39.

Moreover, formed at the rear end portion of first filter member 32 is a curve-shaped portion 45 that is curved upward. When first filter member 32 is accommodated in filter accommodating member 31, rear end surface 45*a* of curve-shaped portion 45 is brought into contact with rear inner surface 31*a* of filter accommodating member 31. Further, rear end surface 33*a* of second filter member 33 also contacts rear inner surface 31*a* of filter accommodating member 31.

In addition, second filter member 33 has magnet 46, and by accommodating second filter member 33 along with first filter member 32 in filter accommodating member 31, magnet 46 can be disposed in the vicinity of magnetic force detecting unit (second filter detecting unit) 47 which is installed outside filter accommodating member 31. Magnetic force detecting unit 47 can determine the presence or absence of second filter member 33 by detecting a magnetic force due to magnet 46.

In the above configuration, air inlet 34 and air outlet 35 are formed at the bottom surface of filter accommodating member 31, whereas no opening serving as an air flow passage is provided at the top surface thereof. Therefore, lint trap device 22 can be installed at the upper end portion of main body 1. Furthermore, since first filter member 32 and second filter member 33 are configured to be attached to or detached from filter accommodating member 31 by being moved in back and forth direction while being integrated with each other, lint trap device 22 can be installed at the front end portion of main body 1. Thus, by using these configurations, lint trap device 22 can be installed at the corner of the front upper portion of main body 1, whereby it can be readily seen and used by user.

Further, air inlet 34 may be installed at the lateral surface of filter accommodating member 31 instead of being at the bottom surface. That is to say, same effect can be realized as long as it is not provided at the top surface of filter accommodating unit 31.

Since, first filter 37 of first filter member 32 and second filter 39 of second filter member 33 are all formed in approximately planar shapes, the work of removing lint can be facilitated greatly compared to a case of using bag-shaped filters.

Moreover, by setting the size of the meshes of second filter 39 to be equal to or finer than that of the meshes of first filter 37, lint can be surely filtered out without being accumulated in air circulation channel 16. As a consequence, deterioration of air circulation and drying efficiency due to the accumulation of lint in air circulation channel 16 can be prevented.

In case of attaching second filter member 33 to first filter member 32, by fitting hook rib 40 into hook engagement opening 41 and rotating second filter member 33 in the direction of the arrow A such that first filter member 32 overlaps with second filter member 33, locking portion 43 is bent inside toward second opening 38, whereby protrusion rib 42 is inserted through opening 43*a* of locking portion 43 to be engaged in that position. As a result, second filter member 33 can be attached to first filter member 32 such that first filter member 32 is placed on top of second filter member 33. Furthermore, in case of detaching second filter member 33 from first filter member 32, by bending locking portion 43 inside toward second opening 38, protrusion rib 42 can be released from opening 43*a* of locking portion 43, and detachment of second filter member 33 can be performed by applying the method in reverse order to that for the attachment thereof. Thus, by making it easy to attach or detach the first filter member and the second filter member, the removal of lint attached thereto can be achieved readily with improved user convenience.

Furthermore, since handle 44 is formed such that it is located on the same plane as front frame 6, the drum type washing and drying machine can be given further improved appearance.

Even in case user forgets to install first filter member 32, he/she can easily notice by eye observation the absence of first filter member 32 readily at a time of starting a washing process or a drying process. Therefore, deterioration of air circulation and drying efficiency due to the accumulation of lint in air circulation channel 16 can be avoided.

Moreover, even in case user accommodates only first filter member 32 in filter accommodating member 31 while forgetting to engage second filter member 33 to first filter member 32, the absence of second filter member 33 can be detected by magnetic force detecting unit 47 disposed outside filter accommodating member 31. That is, second filter member 33 has magnet 46, and, in case second filter member 33 is not installed, magnetic force detecting unit 47 detects the absence of magnet 46 and informs the user of the problem via control panel 20. Therefore, deterioration of air circulation and drying efficiency due to the accumulation of lint in air circulation channel 16 can be prevented.

Furthermore, since first filter member 32 has curve-shaped portion 45, which curves upward, at the rear end portion thereof, and curve-shaped portion 45 is configured such that rear end surface 45*a* of curve-shaped portion 45 contacts rear inner surface 31*a* of filter accommodating member 31 when first filter member 32 is accommodated in filter accommodating member 31, the surface area of first filter 37 can be enlarged, and the time period taken for the entire surface of first filter 37 to be covered with lint can be lengthened. As a consequence, user convenience can be improved. In addition, by making rear end surface 45*a* of curve-shaped portion 45 and rear end surface 33*a* of second filter member 33 contact with rear inner surface 31*a* of filter accommodating member 31, lint can be prevented from escaping through a gap therebetween.

Furthermore, though rotating shaft 2*a* is installed at the center of rotation of rotary drum 2 slantingly and rotary drum is disposed such that its rotational axis is declined toward the rear portion of main body 1 of the drum type washing and drying machine in accordance with the preferred embodiment of the present invention, it is also possible to install rotating shaft 2*a* at the center of rotation of rotary drum 2 in a horizontal direction and dispose rotary drum 2 such that its rotational axis is horizontal.

As described, the drum type washing and drying machine in accordance with the present invention prevents user from operating the machine without installing the lint trap device and allows the removal of lint from the lint trap device to be performed easily, thereby providing improved user convenience.

While the invention has been shown and described with respect to the preferred embodiments of the present invention, it will be understood by those skilled in the art that various changes and modifications may be made without departing from the spirit and scope of the invention as defined in the following claims.

What is claimed is:

1. A drum type washing and drying machine comprising:

a cylindrical rotary drum provided with multiple drum perforations on the cylindrical surface thereof and having a rotating shaft in a horizontal or a slanted direction, a water tub, supported in a main body of the drum type washing and drying machine, for accommodating the rotary drum therein;

an air circulation channel for re-circulating air exhausted from the rotary drum back into the rotary drum via a dehumidification unit and a heating unit; and a lint trap device, installed in the air circulation channel, for filtering lint generated from laundry, wherein the lint trap device at least includes a first filter member and a second filter member capable of being detachably attached to each other, and an assembly of the first filter member and the second filter member is installed at a front upper portion of the main body, the assembly being attachably and detachably installed in an approximately horizontal direction.

2. The washing and drying machine of claim 1, wherein the first filter member includes a first filter of an approximately planar shape and the second filter member includes a second filter of an approximately planar shape, a mesh size of the second filter being equal to or finer than that of the first filter; air flows in a direction from the first filter to the second filter in the lint trap device; and the first filter member is placed on top of the second filter member.

3. The washing and drying machine of claim 1, wherein the second filter member is attached to the first filter member by being engaged at a front and a rear portion thereof, wherein the rear portion includes an other portion excluding the front portion.

4. The washing and drying machine of claim 2, wherein the second filter member is attached to the first filter member by being engaged at a front and a rear portion thereof, wherein the rear portion includes an other portion excluding the front portion.

5. The washing and drying machine of claim 1, wherein the lint trap device is installed at a portion of the air circulation channel, the portion allowing air to flow upward from an air inlet at a front lower portion of the lint trap device while allowing air to flow downward from an air outlet at a rear lower portion of the lint trap device; the first and the second filter member are provided with a first and a second opening at portions thereof corresponding to the air inlet, respectively, while the first and the second filter are provided at portions of the first and the second filter member corresponding to the air outlet, respectively.

6. The washing and drying machine of claim 2, wherein the lint trap device is installed at a portion of the air circulation channel, the portion allowing air to flow upward from an air inlet at a front lower portion of the lint trap device while allowing air to flow downward from an air outlet at a rear lower portion of the lint trap device; the first and the second filter member are provided with a first and a second opening at portions thereof corresponding to the air inlet, respectively, while the first and the second filter are provided at portions of the first and the second filter member corresponding to the air outlet, respectively.

7. The washing and drying machine of claim 5, wherein a handle of the first filter member is exposed to a front surface of the main body to thereby form a part of a casing thereof; a hook rib that protrudes forward and upward is formed at a front portion of the second filter member; a hook engagement opening for receiving the hook rib to be fitted thereinto is provided at the first filter member; a protrusion rib protruded into the first opening is formed at a rear end portion of the first opening; and a locking portion for being engaged with the protrusion rib is formed at a rear end portion of the second opening of the second filter member.

8. The washing and drying machine of claim 6, wherein a handle of the first filter member is exposed to a front surface of the main body to thereby form a part of a casing thereof; a hook rib that protrudes forward and upward is formed at a front portion of the second filter member; a hook engagement opening for receiving the hook rib to be fitted thereinto is provided at the first filter member; a protrusion rib protruded into the first opening is formed at a rear end portion of the first opening; and a locking portion for being engaged with the protrusion rib is formed at a rear end portion of the second opening of the second filter member.

9. The washing and drying machine of claim 1, wherein a second filter detecting unit for detecting the presence or absence of the second filter member is installed on the air circulation channel.

10. The washing and drying machine of claim 2, wherein a second filter detecting unit for detecting the presence or absence of the second filter member is installed on the air circulation channel.

11. The washing and drying machine of claim 1, wherein a rear end portion of the first filter member is formed to have a curved portion that curves upward, and a rear end surface of the curved portion is in contact with a rear inner surface of a filter accommodating member accommodating therein the first and the second filter member.

12. The washing and drying machine of claim 2, wherein a rear end portion of the first filter member is formed to have a curved portion that curves upward, and a rear end surface of the curved portion is in contact with a rear inner surface of a filter accommodating member accommodating therein the first and the second filter member.

* * * * *